US011782356B2

(12) United States Patent
Hagiwara et al.

(10) Patent No.: US 11,782,356 B2
(45) **Date of Patent: *Oct. 10, 2023**

(54) DEVELOPING APPARATUS, PROCESS CARTRIDGE, AND IMAGE FORMING APPARATUS

(71) Applicant: CANON KABUSHIKI KAISHA, Tokyo (JP)

(72) Inventors: Kazunari Hagiwara, Kanagawa (JP); Taichi Sato, Kanagawa (JP); Takahiro Kawamoto, Kanagawa (JP); Yasukazu Ikami, Tokyo (JP); Shoko Funaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/841,049

(22) Filed: Jun. 15, 2022

(65) Prior Publication Data

US 2022/0317591 A1 Oct. 6, 2022

Related U.S. Application Data

(63) Continuation of application No. 17/469,042, filed on Sep. 8, 2021, now Pat. No. 11,442,376.

(30) Foreign Application Priority Data

Sep. 11, 2020 (JP) ..... 2020-153306

(51) Int. Cl.
*G03G 15/09* (2006.01)
*G03G 15/08* (2006.01)
*G03G 21/18* (2006.01)
*G03G 9/093* (2006.01)

(52) U.S. Cl.
CPC ..... *G03G 15/0812* (2013.01); *G03G 21/1814* (2013.01); *G03G 9/093* (2013.01)

(58) Field of Classification Search
CPC ..... G03G 9/08; G03G 9/0802; G03G 9/0819; G03G 9/093; G03G 9/09342; G03G 15/0812; G03G 21/1814
See application file for complete search history.

(56) References Cited

U.S. PATENT DOCUMENTS

2005/0026063 A1* 2/2005 Komoto ..... G03G 9/08702 430/108.7
2009/0186290 A1* 7/2009 Yoshizaki ..... G03G 9/09392 430/111.4
2013/0216276 A1* 8/2013 Ogawa ..... G03G 15/0812 399/284

* cited by examiner

*Primary Examiner* — Hoang X Ngo
(74) *Attorney, Agent, or Firm* — Canon U.S.A., Inc., IP Division

(57) ABSTRACT

A developer used in a developing apparatus equipped with a metal blade includes a toner base particle and external additives, the external additives including a silica particle with a particle diameter of 5 nm or more and 25 nm or less and an inorganic spacer particle with a particle diameter of 50 nm or more and 150 nm or less, and an area occupancy of the silica particle on a surface of the toner base particle is 40% or more.

12 Claims, 10 Drawing Sheets

FIG. 6

AREA OCCUPANCY H OF SILICA FINE PARTICLE S1 ON SURFACE OF TONER BASE PARTICLE

| PARTICLE DIAMETER n OF SILICA FINE PARTICLE S1 ON SURFACE OF TONER BASE PARTICLE (nm) | 0.3 | 0.35 | 0.4 | 0.45 | 0.5 | 0.55 | 0.6 | 0.65 | 0.7 | 0.75 | 0.8 | 0.85 | 0.9 | 0.95 | 1 |
|---|---|---|---|---|---|---|---|---|---|---|---|---|---|---|---|
| 5 | 10.5 | 9.8 | 9.1 | 8.6 | 8.2 | 7.8 | 7.5 | 7.2 | 6.9 | 6.7 | 6.5 | 6.3 | 6.1 | 5.9 | 5.8 |
| 10 | 21.1 | 19.5 | 18.3 | 17.2 | 16.3 | 15.6 | 14.9 | 14.3 | 13.8 | 13.3 | 12.9 | 12.5 | 12.2 | 11.8 | 11.5 |
| 15 | 31.6 | 29.3 | 27.4 | 25.8 | 24.5 | 23.4 | 22.4 | 21.5 | 20.7 | 20 | 19.4 | 18.8 | 18.3 | 17.8 | 17.3 |
| 20 | 42.2 | 39 | 36.5 | 34.4 | 32.7 | 31.1 | 29.8 | 28.6 | 27.6 | 26.7 | 25.8 | 25 | 24.3 | 23.7 | 23.1 |
| 25 | 52.7 | 48.8 | 45.6 | 43 | 40.8 | 38.9 | 37.3 | 35.8 | 34.5 | 33.3 | 32.3 | 31.3 | 30.4 | 29.6 | 28.9 |
| 30 | 63.2 | 58.6 | 54.8 | 51.6 | 49 | 46.7 | 44.7 | 43 | 41.4 | 40 | 38.7 | 37.6 | 36.5 | 35.5 | 34.6 |
| 35 | 73.8 | 68.3 | 63.9 | 60.2 | 57.2 | 54.5 | 52.2 | 50.1 | 48.3 | 46.7 | 45.2 | 43.8 | 42.6 | 41.5 | 40.4 |
| 40 | 84.3 | 78.1 | 73 | 68.9 | 65.3 | 62.3 | 59.6 | 57.3 | 55.2 | 53.3 | 51.6 | 50.1 | 48.7 | 47.4 | 46.2 |
| 45 | 94.9 | 87.8 | 82.2 | 77.5 | 73.5 | 70.1 | 67.1 | 64.5 | 62.1 | 60 | 58.1 | 56.4 | 54.8 | 53.3 | 52 |
| 50 | 105.4 | 97.6 | 91.3 | 86.1 | 81.6 | 77.8 | 74.5 | 71.6 | 69 | 66.7 | 64.5 | 62.6 | 60.9 | 59.2 | 57.7 |

DEVELOPING APPARATUS, PROCESS CARTRIDGE, AND IMAGE FORMING APPARATUS

CROSS-REFERENCE TO RELATED APPLICATIONS

This application is a continuation of U.S. application Ser. No. 17/469,042, filed Sep. 8, 2021, which claims the benefit of Japanese Patent Application No. 2020-153306, filed Sep. 11, 2020, each of which is hereby incorporated by reference herein in their entirety.

BACKGROUND OF THE INVENTION

Field of the Invention

The present disclosure relates to an image forming apparatus and to a developing apparatus and a process cartridge each used in the image forming apparatus. More particularly, the present disclosure relates to an electrophotographic image forming apparatus using electrophotography and to a developing apparatus and a process cartridge each used in the electrophotographic image forming apparatus.

Description of the Related Art

Hitherto, a technique of contacting (abutting) a free end of a metal-made developing blade with a surface of a developing roller, and then regulating a layer of toner coated on the developing roller and applying electric charges to the toner through triboelectric charging with rotation of the developing roller has been widely known.

Meanwhile, Japanese Patent No. 4370422 proposes a technique of, in the case of using the metal-made developing blade, adding inorganic fine particles with predetermined particle diameters to toner in order to improve flowability (chargeability) of the toner.

More specifically, the technique proposed in Japanese Patent No. 4370422 uses the toner to which multiple types of inorganic fine particles with different average diameters are added. A small-diameter inorganic fine particle included in the toner contributes to improving chargeability of the toner, and a large-diameter inorganic fine particle contributes to suppressing the small-diameter inorganic fine particle from being buried into a toner base particle. The flowability (chargeability) of the toner is improved with the combined use of the fine particles with the different diameters.

However, the technique proposed in Japanese Patent No. 4370422 has a possibility that, as the number of image forming operations increases (namely, as a cumulative use time increases), the large-diameter inorganic fine particle may be buried into the toner base particle. The large-diameter inorganic fine particle having been buried into and integrated with the toner base particle strengthens an action of abrading a front edge portion (abutment portion) of the metal-made developing blade, thus changing a contact state of the metal blade with the developing roller or a situation of the toner being taken into the abutment portion due to abrasion. Hence a regulation failure, such as a "coating variation", is more likely to occur.

SUMMARY OF THE INVENTION

In consideration of the above-described disadvantage, the present disclosure provides a developing apparatus, a process cartridge, and an image forming apparatus each of which can suppress the occurrence of the coating variation while improving chargeability of a developer coating layer that is formed on a developer bearing member.

A developing apparatus according to one aspect of the present disclosure includes: a developing frame configured to store a developer; a developer bearing member rotatably supported by the developing frame and configured to bear the developer; and a regulation member including a metal blade, the metal blade having one end fixed to the developing frame and the other end arranged in contact with the developer bearing member, the regulation member regulating a thickness of the developer borne on the developer bearing member, wherein the developer includes a toner base particle and external additives, the external additives include a silica particle with a particle diameter of 5 nm or more and 25 nm or less, and an inorganic spacer particle with a particle diameter of 50 nm or more and 150 nm or less, and an area occupancy of the silica particle on a surface of the toner base particle is 40% or more.

A developing apparatus according to another aspect of the present disclosure includes: a developing frame configured to store a developer; a developer bearing member rotatably supported by the developing frame and configured to bear the developer, and a regulation member including a metal blade, the metal blade having one end fixed to the developing frame and the other end arranged in contact with the developer bearing member, the regulation member regulating a thickness of the developer borne on the developer bearing member, wherein the developer includes a toner base particle with an organic silica-containing surface layer made of an organic silicon compound, and an external additive, the external additive includes an inorganic spacer particle with a particle diameter of 50 nm or more and 150 nm or less, and an area occupancy of the organic silicon compound on a surface of the toner base particle is 40% or more.

Further features of the present disclosure will become apparent from the following description of exemplary embodiments with reference to the attached drawings.

BRIEF DESCRIPTION OF THE DRAWINGS

FIG. 6 is a table indicating relations among a particle diameter (n) of the silica fine particle on the surface of the toner base particle, an area occupancy H of the silica fine particle thereon, and an outer diameter MR of an imaginary circle.

DESCRIPTION OF THE EMBODIMENTS

Example 1

Configuration of Image Forming Apparatus

Figure 1:
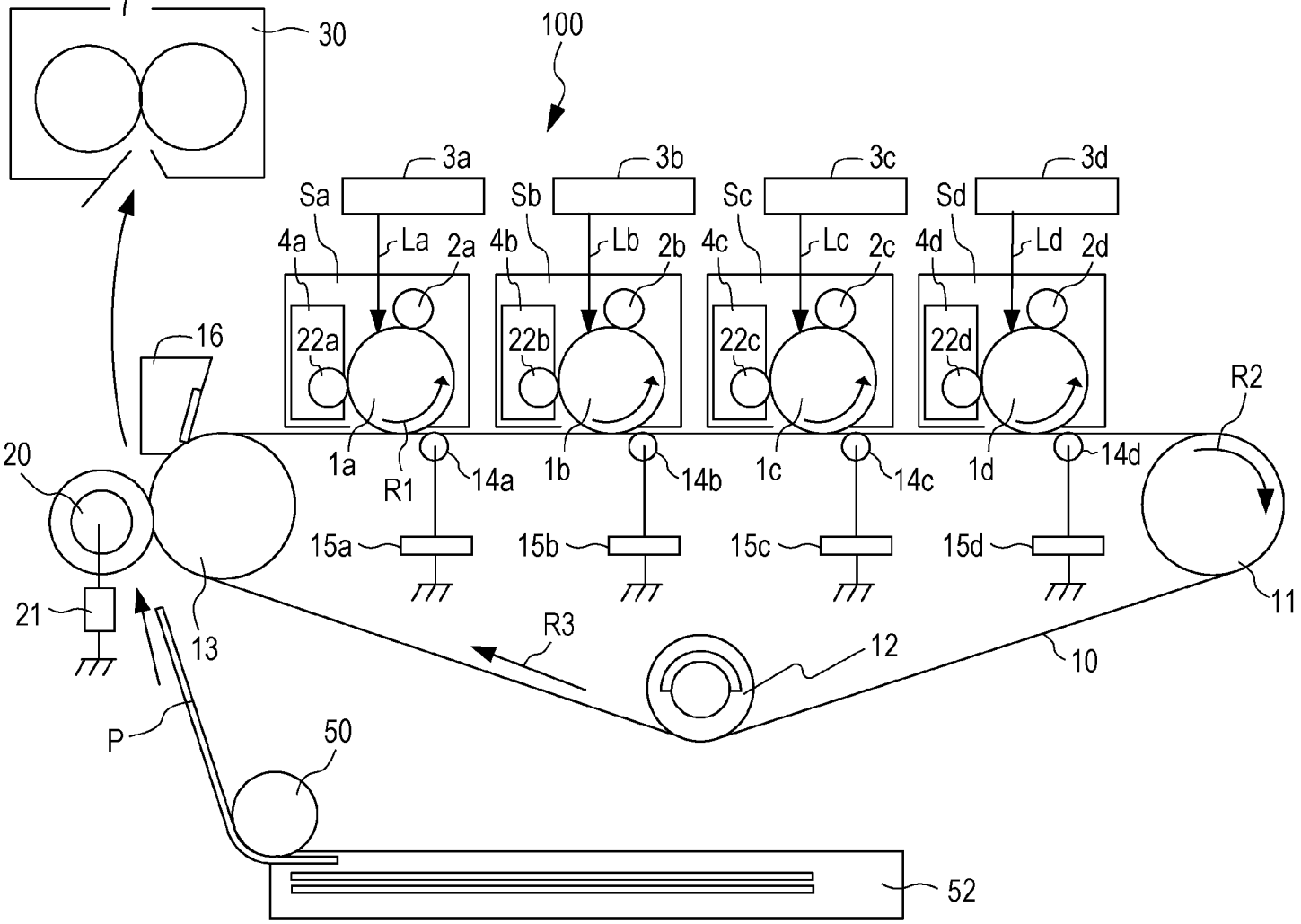
FIG. 1 is a conceptual sectional view of an image forming apparatus according to Example 1 of the present disclosure.

An overall configuration of an electrophotographic image forming apparatus (hereinafter called an "image forming apparatus") according to the present disclosure will be described below. FIG. 1 is a conceptual sectional view of the image forming apparatus 100 according to this Example.

The image forming apparatus 100 according to this example is a full-color laser printer using an in-line system and an intermediate transfer system.

The image forming apparatus 100 can form a full-color image on a recording material P (for example, recording paper or a plastic sheet) in accordance with image information. The image information is input to the image forming apparatus 100 from an image reading apparatus or a host device such as a personal computer connected to be able to communicate with the image forming apparatus 100.

The image forming apparatus 100 includes, as multiple image forming units, first, second, third, and fourth process cartridges Sa, Sb, Sc and Sd for forming images in colors of yellow (Y), magenta (M), cyan (C), and black (K), respectively. In this Example, the first to fourth process cartridges Sa, Sb, Sc and Sd are arranged in a row in a direction crossing the vertical direction. In this Example, configurations and operations of the first to fourth process cartridges Sa, Sb, Sc and Sd are substantially the same except that the colors of images to be formed are different from one another. In the following, therefore, unless there is a particular need to distinguish the individual process cartridges, the suffixes a, b, c and d each added to indicate that the process cartridge corresponds to which one of the four colors are omitted, and the expression "process cartridge" is used in collective meaning.

In this Example, the image forming apparatus 100 includes, as multiple image bearing members, four drum-type electrophotographic photoreceptors, namely photosensitive drums 1 (1*a*, 1*b*, 1*c* and 1*d*), that are disposed side by side in the direction crossing the vertical direction. The photosensitive drums 1 are each driven and rotated by a driving unit (driving source) not illustrated. Around each photosensitive drum 1, there are disposed a charging roller 2 (2*a*, 2*b*, 2*c* or 2*d*), a scanner unit (exposure apparatus) 3 (3*a*, 3*b*, 3*c* or 3*d*), and a developing unit (developing apparatus) 4 (4*a*, 4*b*, 4*c* or 4*d*). The charging roller 2 is a charging unit configured to uniformly charge a surface of the photosensitive drum 1.

The scanner unit 3 is an exposure unit configured to emit a laser beam and to form an electrostatic image (electrostatic latent image) on the photosensitive drum 1 in accordance with a calculation output that is obtained by a CPU (not illustrated) from image information input from the host device such as the personal computer. The developing unit 4 is a developing unit configured to develop the electrostatic latent image as a developer (hereinafter called "toner") image. The photosensitive drum 1 is integrated with the charging roller 2 and the developing unit 4 each serving as a process unit applying an action to the photosensitive drum 1, thus forming the process cartridge S.

The process cartridge S is removably mounted to the image forming apparatus 100 through a mounting unit, such as a mounting guide and a positioning member, disposed in the image forming apparatus 100.

An intermediate transfer belt 10 serving as an intermediate transfer member to transfer the toner image on the photosensitive drum 1 onto the recording material P is disposed opposite to the four photosensitive drums 1. The intermediate transfer belt 10 in the form of an endless belt is held in abutment with all the photosensitive drums 1 and is cyclically moved (rotated) in a direction denoted by an arrow R3 in the drawing. The intermediate transfer belt 10 is looped over multiple support members, namely an opposing roller 13 for secondary transfer, a driving roller 11, and a tension roller 12.

Four primary transfer rollers 14 (14*a*, 14*b*, 14*c* and 14*d*) serving as primary transfer units are disposed in a row on an inner peripheral surface side of the intermediate transfer belt 10 to be opposed to the photosensitive drums 1 in a one-to-one relation. Each of the primary transfer rollers 14 presses the intermediate transfer belt 10 against the photosensitive drum 1 and forms a primary transfer region in which the intermediate transfer belt 10 and the photosensitive drum 1 are in abutment with each other.

A secondary transfer roller 20 serving as a secondary transfer unit is disposed on an outer peripheral surface side of the intermediate transfer belt 10 at a position opposite to the opposing roller 13 for secondary transfer. The secondary transfer roller 20 is held in pressure contact with the opposing roller 13 for secondary transfer with the intermediate transfer belt 10 interposed therebetween and forms a secondary transfer region in which the intermediate transfer belt 10 and the secondary transfer roller 20 are in abutment with each other.

The recording paper P onto which the toner image has been transferred is conveyed to a fixing apparatus 30 serving as a fixing unit. The toner image is fixed to the recording paper P by applying heat and pressure to the recording paper P in the fixing apparatus 30.

The image forming apparatus 100 is configured to be able to form a monochrome or multicolor image by using only desired one of the image forming units or some (not all) of the image forming units.

In this Example, the image forming apparatus 100 is a printer adaptable for a process speed of 148.2 mm/sec and a sheet of A4 size paper.

Image Forming Process

In an image forming period, first, the surface of the photosensitive drum 1 is uniformly charged by the charging roller 2.

Then, scanning exposure is performed on the surface of the photosensitive drum 1 having been charged with the laser beam emitted from the scanner unit 3 in accordance with the calculation output that is obtained by the CPU from the image information input from the host device, and the electrostatic image according to the image information is formed on the photosensitive drum 1.

Then, the electrostatic image formed on the photosensitive drum 1 is developed as the toner image by the developing unit 4.

Then, a voltage with a reverse polarity to a regular charging polarity of the toner is applied to the primary transfer roller 14 (transfer member) from a primary-transfer voltage supply source 15 (high-voltage power supply) serving as a primary-transfer voltage applying unit.

As a result, the toner image on the photosensitive drum 1 is primary transferred onto the intermediate transfer belt 10.

When forming the full-color image, the above-described process is successively performed in the first to fourth process cartridges Sa, Sb, Sc and Sd, and the toner images in the individual colors are successively primary transferred onto the intermediate transfer belt 10 in a superimposed relation.

Thereafter, the recording material P is conveyed to the secondary transfer region in synch with movement of the intermediate transfer belt 10. Then, a voltage with the reverse polarity to the regular charging polarity of the toner is applied to the secondary transfer roller 20 from a secondary-transfer voltage supply source 21 (high-voltage power supply) serving as a secondary-transfer voltage applying unit. As a result, the four-color toner images on the intermediate transfer belt 10 are secondary transferred together at a time onto the recording paper P, which has been conveyed by a feed unit to the secondary transfer region, by the action of the secondary transfer roller 20 held in abutment with the intermediate transfer belt 10 with the recording paper P interposed therebetween.

The recording material P onto which the toner image has been transferred is conveyed to the fixing apparatus 30 serving as the fixing unit. In the fixing apparatus 30, the transferred toner image is fixed to the recording material P by application of heat and pressure. The recording material P is then discharged from the image forming apparatus 100.

To control an amount of the toner developed, the developing unit 4 is configured to perform reversal developing in a manner of contacting a developing roller 22 (described later), which serves as a developer bearing member, with the photosensitive drum 1 while a speed difference is given between them. More specifically, the developing unit 4 used here is configured to develop the electrostatic image by attaching the toner charged with the same polarity (negative polarity in this Example) as the charging polarity of the photosensitive drum 1 to a region (image region or exposure region) on the photosensitive drum 1 where charges have been attenuated with the exposure. In this Example, the developing roller 22 is moved at a speed ratio 1.4 times with respect to the photosensitive drum 1.

Transfer residual toner remaining on the surface of the photosensitive drum 1 after a primary transferring step is collected by the developing roller 22 (described later) and is reused. The transfer residual toner remaining on the surface of the photosensitive drum 1 after the primary transferring step is charged to the regular charging polarity at the time of passing the charging roller 2. Thereafter, the transfer residual toner is collected by the developing roller 22 for reuse under an electric field that is formed due to a difference between a potential of the photosensitive drum 1 formed by the charging roller 2 and a potential of the developing roller 22 formed by application of a direct current voltage to the developing roller 22.

Configuration of Process Cartridge

Figure 2:
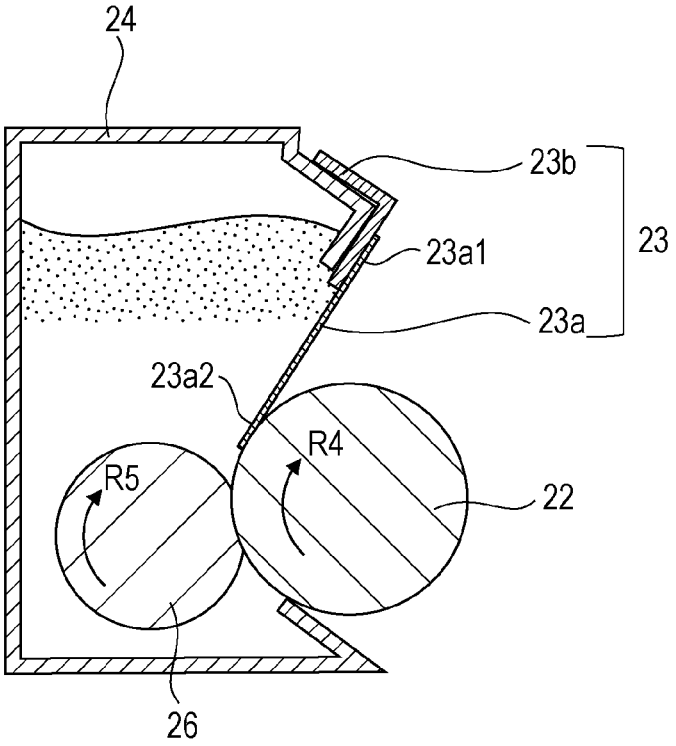
FIG. 2 is a conceptual sectional view of a developing apparatus used in the image forming apparatus according to Example 1 of the present disclosure.

An overall configuration of the process cartridge S mounted to the image forming apparatus 100 according to this Example will be described below (with reference to FIG. 1). The developing unit 4 constituting part of the process cartridge S is described with reference to FIG. 2. FIG. 2 is a conceptual sectional view of the developing unit (apparatus).

The process cartridges S for the individual colors have the same shape except for identification portions and so on (not illustrated). Toners in the individual colors of yellow (Y), magenta (M), cyan (C), and black (K) are stored in the developing units 4 of the process cartridges S for the individual colors in a one-to-one relation. In the developing units 4, nonmagnetic one-component toner is used as the developer.

The process cartridge S is constituted by integrating a photosensitive unit including the photosensitive drum 1 and the rotatable charging roller 2 with the developing unit (apparatus) 4 including the rotatable developing roller 22 and so on.

The photosensitive drum 1 is rotatably supported through a bearing (not illustrated). A driving force from the not-illustrated driving unit (driving source) is transmitted to the photosensitive drum 1, whereby the photosensitive drum 1 is driven and rotated in a direction denoted by an arrow R1 in the drawing in accordance with the image forming operation. The charging roller 2 has a roller portion made of conductive rubber and held in pressure contact with the photosensitive drum 1 to be frictionally rotated.

On the other hand, the developing unit (apparatus) 4 includes the developing roller 22 bearing the toner, a developing blade 23 (metal blade) constituting a regulation member, a supply member 26 disposed in contact with the developing roller, and a developing frame 24 fixedly supporting the above-mentioned components.

One end of the developing blade 23 is fixed to a support member 23*b* that is fixed to the developing frame 24, and the other end of the developing blade 23 is held in abutment with the developing roller 22 to be able to regulate a toner amount coated on the developing roller 22 and to apply charges to the developing roller 22. The developing roller 22 is disposed in a development opening to be able to abut with the photosensitive drum 1. The developing roller 22 is driven and rotated in a direction denoted by an arrow R4 in the drawing.

In this Example, the developing roller 22 and the photosensitive drum 1 are rotated such that surfaces of the developing roller 22 and the photosensitive drum 1 in an opposing region are moved in the same direction (from above to below in the gravitational direction in this Example). A predetermined direct current is applied as a developing bias to the developing roller 22, and the toner negatively charged with triboelectric charging visualizes the electrostatic latent image to form the toner image in a developing region where the developing roller 22 contacts with the photosensitive drum 1.

Regulation Member

The developing blade 23 (regulation member) will be described below.

The developing blade 23 is, as illustrated in FIG. 2, held in abutment with the developing roller 22 to orient in a counter direction and has the functions of regulating a toner coating amount and applying the charges.

In this Example, a metal-made SUS plate 23*a* (metal blade) in the form of a leaf spring with a thickness of 50 to 120 μm and the support member 23*b* are used as the developing blade 23, and a surface of the developing blade is held in abutment with the developing roller 22 with the aid of spring elasticity of the metal-made SUS plate 23*a*. A portion of the developing blade 23 on the other end side in a widthwise direction is formed as the metal blade, and the one end thereof is fixed to and supported by the developing frame 24. The developing blade 23 is not limited to the above-mentioned example. The support member can be made of a SUS plate or made of a thin metal plate of, for example, phosphor bronze or aluminum. A metal, such as SUS, phosphor bronze, or aluminum, can be used for the metal blade from the viewpoint of applying the charges to the toner. In this Example, SUS is used. Voltages applied, as the predetermined direct current voltages, to the developing blade 23 and the developing roller 22 are set to the same values for stabilizing the performance of providing the charges to the toner.

The supply member 26 is constituted by a conductive core metal with an outer diameter of 4 (mm) and a urethane sponge layer made of a soft continuous foam body and formed around the core metal. An outer diameter of the supply member 26 is 11 (mm). Because of using the urethane sponge layer made of the soft continuous foam body, the supply member 26 can hold the toner inside the sponge. The supply member 26 is supported by the developing frame 24 to be held in contact with the developing roller 22 and to be rotationally driven in a direction denoted by an arrow R5 in the drawing during the developing operation.

The developing roller 22 serving as the developer bearing member is formed by successively laminating a base layer and a surface layer made of urethane around a metal core. The developing bias is applied to the surface layer and the base layer through the core metal.

Carbon black is preferably used because the conductivity of the conductive elastic layer and the charging performance of the conductive elastic layer for the toner can be controlled with use of the carbon black. The volume resistivity of the conductive elastic layer is preferably within a range of $1\times10^{3}$ Ω·cm or more to $1\times10^{11}$ Ω·cm or less. In this Example, $1\times10^{6}$ Ω·cm is used.

Mounting of the developing blade 23 will be described in detail below with reference to FIG. 7.

Figure 7:
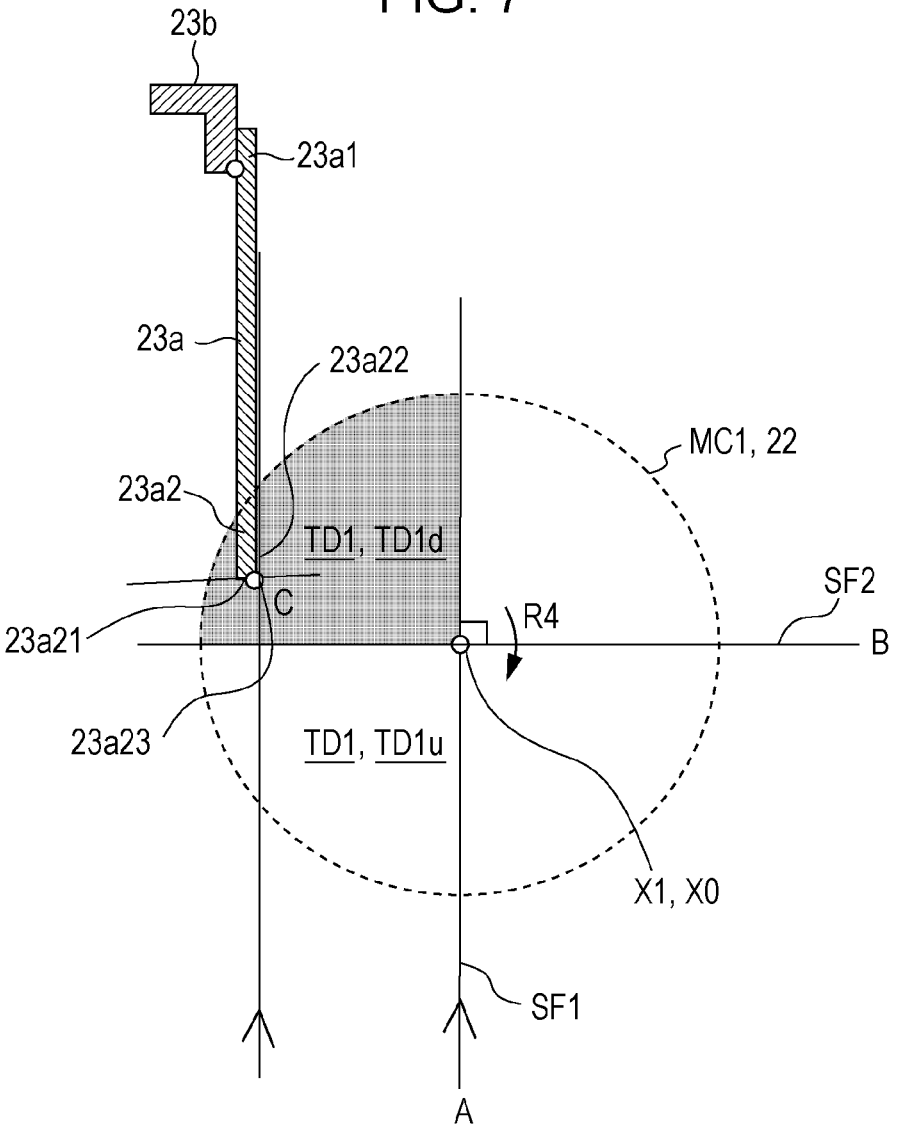
FIG. 7 is a conceptual sectional view illustrating relative positions of a developing blade and a developing roller both used in Example 1 of the present disclosure.

FIG. 7 is a conceptual sectional view illustrating a mounted state (posture) of the developing blade before the developing roller is attached. For reference, an imaginary outer diameter circumference (outer peripheral surface) MC1 of the developing roller is denoted by a dotted line in FIG. 7.

As illustrated in FIG. 7, one end 23*a*1 of the metal blade (metal-made SUS plate 23*a*) in the widthwise direction is fixed to the developing frame 24 through the support member 23*b*. The other end 23*a*2 of the metal blade in the widthwise direction is a free end.

Assume here that the developing roller 22 is imaginarily assembled into the developing frame 24 in a state in which the developing roller 22 is not assembled in the developing frame 24. When looking along a rotation axis direction X1 of the developing roller in such an imaginarily assembled state, an intersection 23*a*23 at which a front edge surface 23*a*21 at the other end 23*a*2 (free end) of the developing blade 23 intersects an abutment surface 23*a*22 thereof abutting with the developing roller is positioned within an imaginary outer diameter circumference MC1 of the developing roller 22. In addition, assuming a first imaginary plane SF1 passing a rotation center X0 of the developing roller 22 and being parallel to the abutment surface 23*a*22 to be a reference, the intersection 23*a*23 is positioned in a first imaginary area TD1 on one side of the first imaginary plane SF1 where the developing blade is present.

Particularly, in this Example, assuming the first imaginary plane SF1 and a second imaginary plane SF2 passing the rotation center X0 of the developing roller and being perpendicular to the first imaginary plane to be references, the intersection 23*a*23 is positioned in a zone TD1*d* within the first imaginary area (TD1) on a downstream side of the second imaginary plane and on an upstream side of the first imaginary plane in the rotation direction R4 of the developing roller. In other words, as illustrated in FIG. 7, the developing blade 23 is disposed to be abutted, at an edge (intersection 23*a*23) of the other end 23*a*2 (free end), with the surface of the developing roller 22.

With the above-described setting, since the free end edge of the developing blade is abutted with the developing roller, a size of a toner intake defined by the regulation member can be reduced, and a higher regulation force can be obtained. Particularly, the highly charged toner has a high electrostatic adhesion force, whereby an adhesion force of the toner with the developing roller and an adhesion force between the toners are increased. However, toner regulation and formation of the toner coating layer can be stably performed according to the configuration of the present disclosure.

Developer

Figure 3:
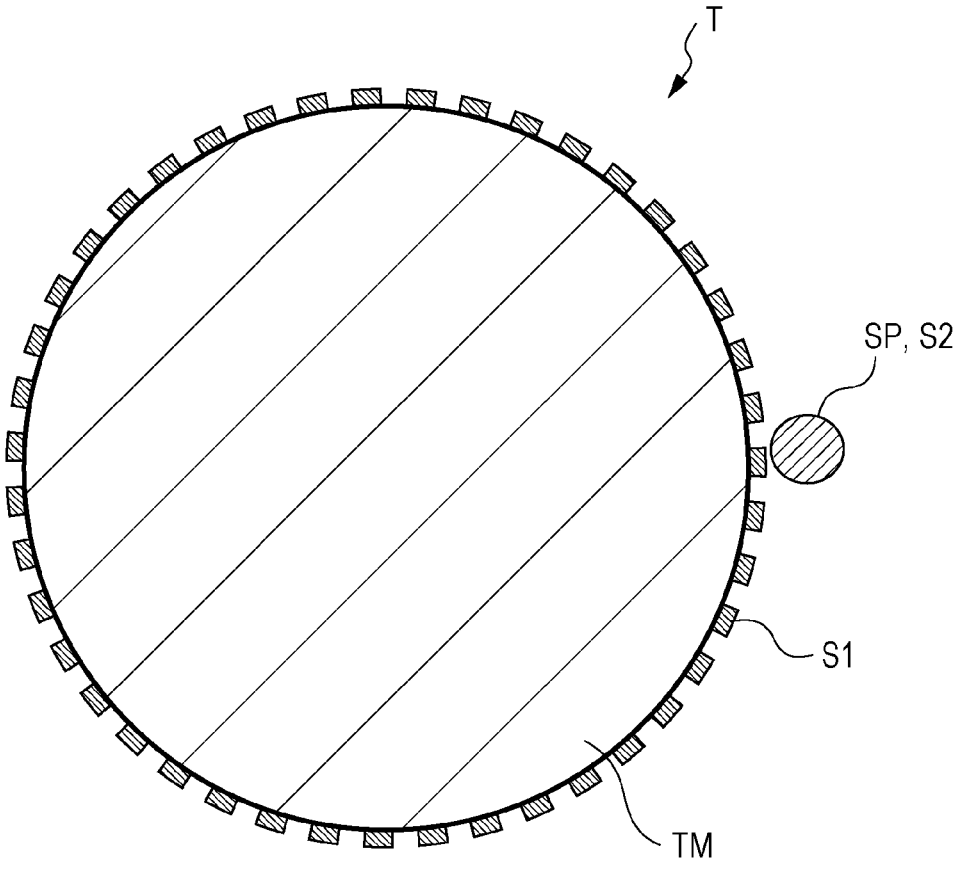
FIG. 3 is a conceptual sectional view of a developer used in Examples 1 to 5 of the present disclosure.

The toner (developer T) used in this Example will be described below with reference to FIG. 3. FIG. 3 is a conceptual sectional view of the toner (developer T).

An average diameter (average particle diameter) of toner particles (including a toner base particle TM and a small-diameter silica fine particle S1) is 7 μm. More specifically, of the toner particles, the small-diameter silica fine particle S1 ("fixed silica" described later) is externally added to a surface of the toner base particle TM at a content of 1.0 part by mass per 100 parts by mass of the toner base particle TM such that the small-diameter silica fine particle S1 adheres to the surface of the toner base particle TM.

Then, 0.6 parts of a silica particle S2 with a particle diameter (r1) of 100 nm in the terms of a primary particle is externally added, as a spacer particle SP, to 100 parts of the toner particle by using a Henschel mixer (Model FM10C, made by NIPPON COKE & ENGINEERING, CO., LTD).

The silica fine particle S1 and the spacer particle SP (the silica particle S2) in this Example are external additives in the present disclosure.

A particle diameter (n) of the silica fine particle S1 (fixed silica) in terms of a primary particle is 5 nm or more and 25 nm or less and preferably 5 nm or more and 15 nm or less.

If the particle diameter (n) of the silica fine particle S1 (fixed silica) in terms of a primary particle is less than 5 nm, the silica fine particle S1 is significantly buried into the toner particle, thus leading to an undesired result that chargeability and flowability can no longer be sufficiently adjusted during long use. On the other hand, if the particle diameter (n) of the silica fine particle S1 in terms of a primary particle is more than 25 nm, a coating variation becomes apparent. The silica fine particle S1 (fixed silica) with the particle diameter of 20 nm is used in this Example.

Spacer Particle

An inorganic particle constituting the spacer particle SP can be made of, for example, silica, alumina, titanium oxide, or boron nitride. Inorganic silica is used in this Example.

In this example, the particle diameter (r1) of the spacer particle SP in terms of a primary particle is 50 nm or more to 150 nm or less.

If the particle diameter (r1) of the spacer particle SP in terms of a primary particle is less than 50 nm, the action as a spacer is small, regulation for burying of the silica fine particle into the toner base particle is weak, and the toner flowability can no longer be sufficiently adjusted. On the other hand, if the particle diameter (r1) of the spacer particle SP in terms of a primary particle is more than 150 nm, the action of abrading the abutment portion of the metal blade is strengthened and the "coating variation" is more likely to occur as described later.

If the particle diameter (r1) of the spacer particle SP is more than 150 nm, adhesion of the spacer particle to, for example, the surface of the developing blade progresses in some cases. In such cases, charges become difficult to transfer from the developing blade to the toner, and this may generate the low-charged toner (namely, fogging).

The particle diameter (r1) of the spacer particle SP in terms of a primary particle is 100 nm in this Example.

Area Occupancy of Silica Fine Particle S1

A step of observing the silica fine particle S1 and the spacer particle SP both adhering to the surface of the toner base particle TM and a method of calculating an area occupancy of the silica fine particle S1 will be described below.

Water Washing Step

20 G of an aqueous solution containing 30% by mass of a precision-machine washing neutral detergent with pH 7, which is composed of "Contaminon N" (nonionic surfactant), an anionic surfactant, and an organic builder, is weighed and put into a vial with a capacity of 50 mL and is mixed with 1 g of the toner.

A prepared mixture is set into "KM Shaker" (model: V.SX) made by IWAKI INDUSTRY CO., LTD. and is shaken for 120 sec with "speed" set to 50. With the shaking, the silica fine particle tending to easily depart from the toner surface is shifted to a dispersion liquid side from the surface of the toner base particle or the toner particle. Thereafter, the toner is separated from the external additives, such as the silica fine particle having been shifted to a supernatant, through centrifugal separation using a centrifugal separator (H-9R: made by KOKUSAN Co., Ltd.) (5 min according to 16.67S-1). The precipitated toner is dried and solidified through vacuum drying (40° C./24 hours), and the toner is obtained after washing with water.

An image of the toner is taken by Hitachi Super-High Resolution Field-Emission Electron Scanning Microscope S-4800 (made by Hitachi High Technologies Corporation).

Identification of a measurement target is performed by an element analysis using the energy dispersive X-ray spectroscopy (EDS). A 5 k ten-thousand magnification is used as an analysis size capable of reflecting the toner surface. An occupancy (area occupancy) H of the silica fine particle S1, represented by a percentage of an area occupied by silica atoms in an analysis area, is calculated.

The above-described calculation is performed on ten toners, and an average of ten calculated values is regarded as the area occupancy H of the silica fine particle S1.

The area occupancy H of the silica fine particle S1 in this Example is 60%.

As described later, when the area occupancy H of the silica fine particle S1 is 40% or more, the spacer particle can be effectively suppressed from fixedly adhering to the toner base particle. Furthermore, when the area occupancy H of the silica fine particle S1 is 40% or more, a sufficient charge amount can be given to the toner.

On the other hand, the area occupancy H of the silica fine particle S1 is desirably 75% or less for the following reason. If the area occupancy H is more than 75%, the toner becomes difficult to fuse when heated (for example, 100° C. or higher), thus leading to a possibility of a fixing failure.

Particle Diameter of Spacer Particle SP

Figure 4A:
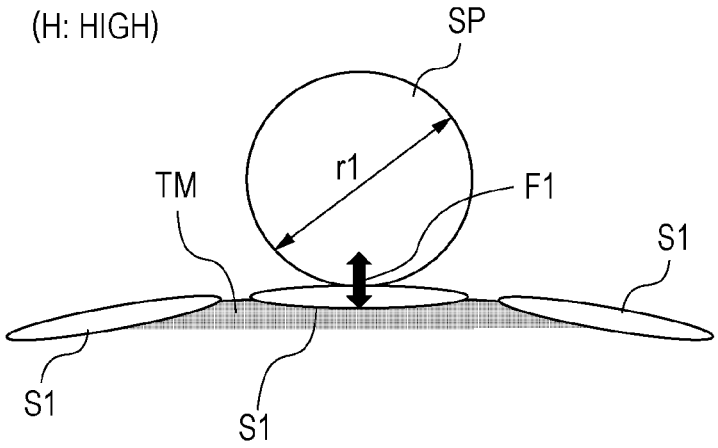
FIGS. 4A and 4B are each a conceptual view illustrating a contact state between a silica fine particle and a spacer particle on a surface of a toner base particle.
Figure 4B:
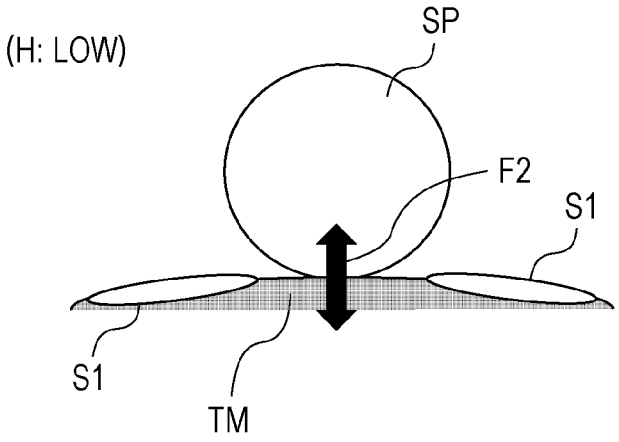

A relation between the particle diameter (r1) of the spacer particle SP and the area occupancy H of the silica fine particle S1 in the present disclosure will be described below with reference to FIGS. 4A and 4B. FIGS. 4A and 4B are each a conceptual view illustrating a "contact state" between the silica fine particle S1 and the spacer particle SP.

A main role of the spacer particle in the present disclosure resides in that the spacer particle is interposed between the toner base particles (parent substances) and suppresses contact between the toner base particles. As a result, the silica fine particle S1 is suppressed from being buried into the toner base particle TM, and the toner particle becomes more easily movable. In other words, the toner flowability (and hence chargeability) is improved.

To improve the toner flowability, as illustrated in FIG. 4A, direct contact between the spacer particle and the toner base particle needs to be suppressed. More specifically, as illustrated in FIG. 4A, a possibility of the spacer particle directly contacting with the toner base particle is reduced by increasing the area occupancy of the silica fine particle on the surface of the toner base particle. Stated in another way, at the high area occupancy, because the spacer particle adheres to the toner base particle in a state in which the silica fine particle S1 is interposed between the spacer particle and the toner base particle, adhesion (adhesion force F1) of the spacer particle to the toner base particle is weakened, and the toner flowability is maintained.

On the other hand, in a state illustrated in FIG. 4B, a resin component of the toner base particle is relatively rich (namely, a resin percentage on the surface of the toner base particle is relatively high), and the area occupancy of the silica fine particle S1 on the surface of the toner base particle is relatively low. In such a case, the spacer particle SP is more likely to contact with the resin component, adhesion (adhesion force F2) of the spacer particle to the toner base particle TM is strengthened. As a result, movement of the spacer particle on the toner surface is restricted, and the toner flowability is reduced in conjunction with the restriction of the movement of the spacer particle.

Particularly, when an external force is applied in a state in which the toner base particle TM and the spacer particle SP are in direct contact with each other (for example, when the toner coating layer on the developing roller passes through an abutment region between the developing roller and another member), the fixed adhesion or the burying of the spacer particle to or into the toner base particle occurs. In such a case, the role of the spacer particle SP reduces, and flowability of the spacer particle itself reduces. Consequently, it becomes difficult to ensure stable toner flowability over time.

Thus, a state in which the spacer particle is less likely to contact with the surface of the toner base particle needs to be formed. In the present disclosure, studies have been conducted in detail on a condition (factor) under which the spacer particle SP is less likely to contact with the resin component of the toner base particle TM. That condition (factor) is described with reference to FIGS. 5A and 5B.

Figure 5A:
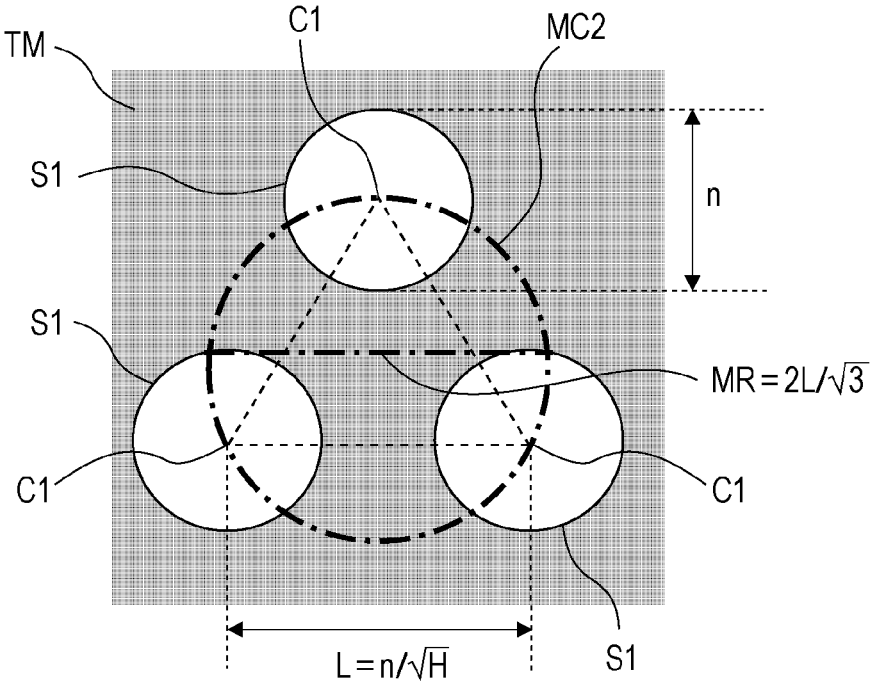
FIGS. 5A and 5B are each a conceptual view illustrating a positional relation between the silica fine particle and the spacer particle on the surface of the toner base particle.
Figure 5B:
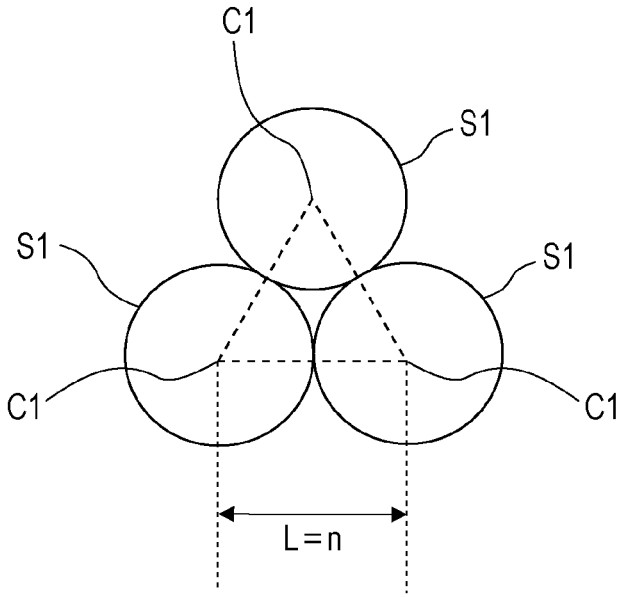

FIGS. 5A and 5B are each a conceptual view illustrating a "positional relation" between the silica fine particle S1 and the spacer particle SP.

More specifically, FIGS. 5A and 5B are each an enlarged conceptual view schematically illustrating a surface condition of the toner base particle. In the drawings, "H" denotes the area occupancy of the "fixed silica" formed of the silica fine particle S1, and "n" denotes the particle diameter of the silica fine particle S1 forming the fixed silica.

FIG. 5B illustrates a state in which the fixed silica (the silica fine particle S1) is close-packed (-arranged) (namely, a state of the area occupancy $H \approx 1$). In that state, a distance between centers C1 of the two adjacent silica fine particles S1 is given by $L=n$.

On the other hand, taking into account the area occupancy denoted by H, the distance L is increased by $1/\sqrt{H}$ and hence the distance between the centers C1 of the two adjacent silica fine particles S1 is given by $L=n/\sqrt{H}$.

An outer diameter (diameter) MR of an imaginary circle MC2 passing the centers C1 of three silica fine particles S1 adjacent to one another is given by 2 L/√3. It is considered that, if the particle diameter (r1) of the spacer particle SP is larger than the outer diameter MR of the imaginary circle MC2 (r1>MR), the contact between the spacer particle and the surface of the toner base particle can be suppressed.

A table of FIG. 6 indicates relations among the particle diameter (n) of the silica fine particle, the area occupancy H of the silica fine particle, and the outer diameter MR of the imaginary circle MC2 on the above-described assumption of MR (=2 L/√3) and L (=n/√H). In other words, FIG. 6 indicates a value of the outer diameter MR when the particle diameter (n) of the silica fine particle S1 forming the fixed silica and the area occupancy H of the silica fine particle are changed.

As described above, the particle diameter (n) of the silica fine particle S1 forming the fixed silica is appropriately held in the range of 5 to 25 nm from the viewpoint of restricting the fixed adhesion of the spacer particle. More specifically, if the particle diameter (n) is less than 5 nm, the burying of the silica fine particle into the toner base particle becomes significant. On the other hand, if the particle diameter (n) is more than 25 nm, the coating variation in the silica fine particle on the surface of the toner base particle becomes apparent.

Furthermore, as described above, the particle diameter of the spacer particle is appropriately 50 nm or more. If the particle diameter of the spacer particle is less 50 nm, the action of the spacer particle as a spacer is small and hence the toner flowability can no longer be sufficiently adjusted.

As a result of conducting intensive studies, the inventors of this application have found that, when the outer diameter MR of the imaginary circle MC2 based on the fixed silica formed of the silica fine particle on the surface of the toner base particle is smaller than a lower limit (50 nm) of the particle diameter of the spacer particle, the spacer particle becomes difficult to come close to the toner base particle due to a relation in volume between both the particles.

Stated in another way, the inventors have succeeded in specifying an appropriate range of the area occupancy H of the silica fine particle, the range satisfying the conditions, indicated in the table of FIG. 6, that "the particle diameter of the silica fine particle S1 forming the fixed silica is (n=5 to 25 nm) and the outer diameter MR of the imaginary circle MC2 is (MR<50 nm). More specifically, when the area occupancy H of the silica fine particle S1 is set to be H>0.40, the charge amount of the toner can be maintained at an appropriate value (if the area occupancy H is less than 0.40, the charge amount of the toner tends to reduce), and the spacer particle SP can be reliably suppressed from fixedly adhering to the toner base particle TM.

If the area occupancy H of the silica fine particle S1 is more than 0.75, it is considered that the fixing failure becomes more like to occur. Therefore, the silica area occupancy H is preferably held in a range of 0.40 to 0.75.

With the above-described configuration, it is possible to maintain the charge amount (chargeability) of the toner at a normal level, to reduce wear (abrasion) of the blade caused by the fixed adhesion of the spacer particle to the toner base particle, and to reduce the coating variation.

To more effectively ensure the toner flowability, the particle diameter of the spacer particle is more preferably set to be not less than about twice the outer diameter MR of the imaginary circle MC2. In this case, the area occupancy H of the silica fine particle can be set to be 0.45 or more, and the particle diameter of the spacer particle can be set to be 80 nm or more.

If the particle diameter (n) of the silica fine particle S1 forming the fixed silica is less than 5 nm, the distance between the silica fine particles S1 is increased in some cases due to significant aggregation of silica, and the spacer particle SP becomes more like to fixedly adhere to the toner base particle TM during long use.

Related Art (Reference Example)

This Reference Example (related art) is in accordance with Example 1 but is different in the following point.

Toner prepared by externally adding the silica fine particle S1 at a content of 0.3 parts by mass per 100 parts by mass of the toner particle is used. The area occupancy H of the silica fine particle S1 is 35%.

Comparative Example 1

Comparative Example 1 is in accordance with Example 1 but is different from Example 1 in the following point.

Toner prepared by externally adding the silica fine particle S1 at a content of 0.3 parts by mass per 100 parts by mass of the toner particle is used. Then, 0.6 parts of the silica particle S2 with the particle diameter of 100 nm in terms of a primary particle is externally added, as the spacer particle SP, to 100 parts of the toner particle by using the Henschel mixer. The area occupancy H of the silica fine particle S1 in this case is 32%.

Example 2

Example 2 is in accordance with Example 1 but is different from Example 1 in the following point.

In Example 1, the other end 23*a*2 (free end) of the developing blade is arranged to be abutted, at the edge (intersection 23*a*23), with the surface of the developing roller 22 (see FIG. 7). In other words, the intersection 23*a*23 is present in the zone TD1*d* within the first imaginary area TD1.

Figure 8:
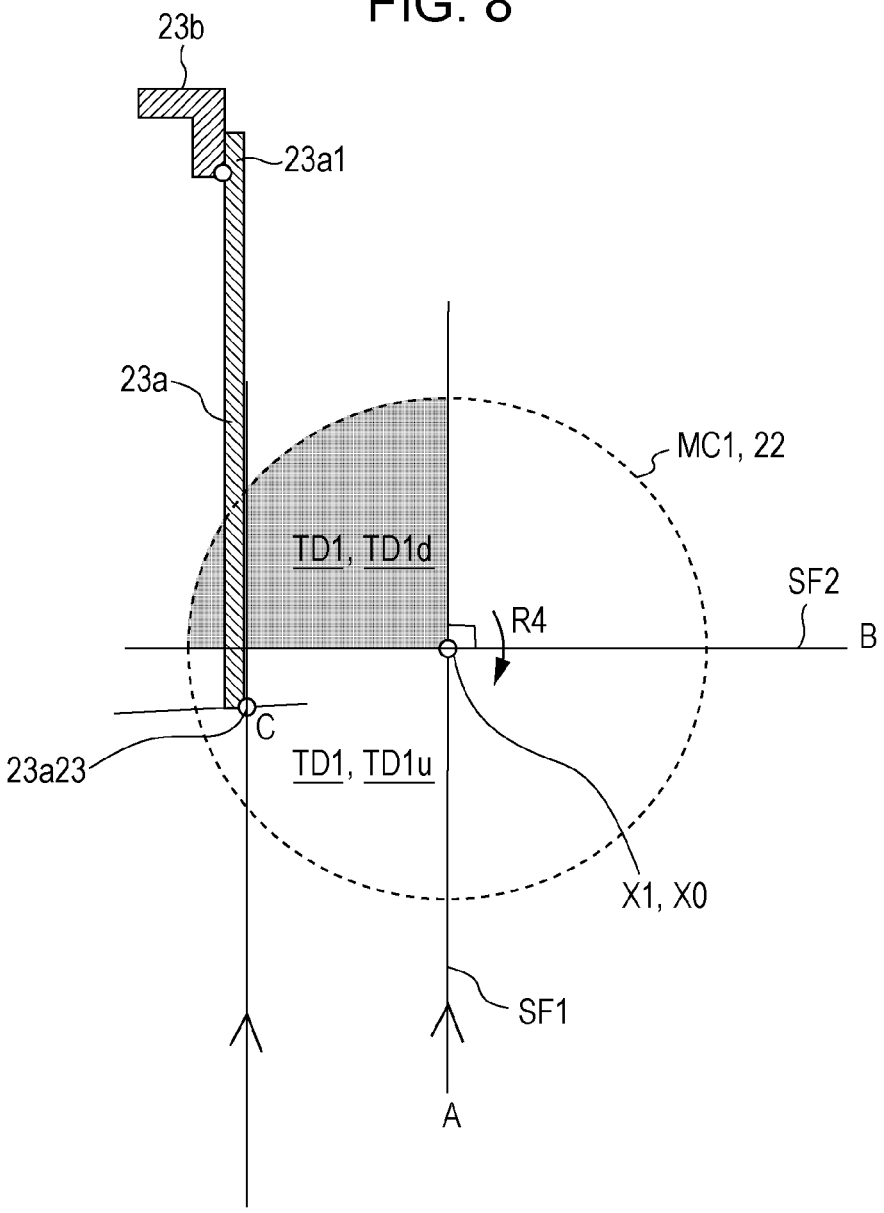
FIG. 8 is a conceptual sectional view illustrating relative positions of the developing blade and the developing roller both used in Example 2 of the present disclosure.

In Example 2, as illustrated in FIG. 8, the intersection 23*a*23 is disposed to position in a zone TD1*u* within the first imaginary area TD1.

More specifically, assuming the first imaginary plane SF1 and the second imaginary plane SF2 perpendicular to the first imaginary plane to be references, the intersection 23*a*23 is positioned in the zone TD1*u* within the first imaginary area TD1 on an upstream side of the second imaginary plane and on a downstream side of the first imaginary plane in the rotation direction R4 of the developing roller. In other words, as illustrated in FIG. 8, the developing blade 23 is disposed to be abutted, at a flat portion (opposing surface 23*a*22) of the other end 23*a*2 (free end), with the surface of the developing roller 22.

Comparing with the configuration illustrated in FIG. 7, the size of the toner intake defined by the regulation member is larger when the edge of the free end of the developing blade, illustrated in FIG. 8, is abutted with the developing roller.

Example 3

Example 3 is in accordance with Example 1 but is different from Example 1 in the following point.

An alumina particle is used as the spacer particle SP.

Example 4

Example 4 is in accordance with Example 1 but is different from Example 1 in the following point.

A bias of −300 V is applied to the developing roller, and a bias of −400 V is applied to the developing blade. A voltage difference of 100 V is formed between the developing roller and the developing blade for the toner with a regular charging polarity being a negative polarity. Because negative charges are applied from the developing blade to the toner, the highly negative-charged toner is obtained.

Example 5

Example 5 is in accordance with Example 1 but is different from Example 1 in the following point.

A bias of −300 V is applied to the developing roller, and a bias of −400 V is applied to the developing blade. An alumina particle is used as the spacer particle SP.

Example 6

Example 6 is in accordance with Example 4 but is different from Example 4 in the following point.

A toner particle TM including a surface layer OS made of an organic silicon polymer is formed as follows.

650.0 Parts of ion exchanged water and 14.0 parts of sodium phosphate (made by RASA Industries, LTD., 12 hydrates) are put into a reaction container equipped with an agitator, a thermometer, and a reflux pipe, and are kept at 65° C. for 1.0 hour while purging nitrogen.

An aqueous medium containing a dispersion stabilizer is prepared by putting an aqueous solution of calcium chloride into the reaction container at a time, the aqueous solution containing 9.2 parts of calcium chloride (2 hydrates) dissolved in 10.0 parts of ion exchanged water, under agitation at 15000 rpm by using T.K. HOMO MIXER (made by Tokushu Kika Kogyo Co., Ltd.). Then, an aqueous medium 1 is obtained by putting 10% by mass of hydrochloric acid into the above-mentioned aqueous medium and adjusting pH to 5.0.

Preparation of Polymerizable Monomer Composition

The following materials are prepared:

Styrene: 60.0 parts

C.I. Pigment Blue 15:3: 6.5 parts

A colorant dispersion liquid is prepared by putting the above-listed materials into an attritor (made by Mitsui Miike Kakoki Co., Ltd.), dispersing those materials at 220 rpm for 5.0 hours while using zirconia particles with a diameter of 1.7 mm, and then removing the zirconia particles.

On the other hand, the following materials are prepared:

Styrene: 20.0 parts n-Butyl acrylate: 20.0 parts

Crosslinking agent (divinylbenzene): 0.3 parts

Saturated polyester resin: 5.0 parts (polycondensation product (mole ratio 10:12) of propylene-oxide modified bisphenol A (2-mole adduct) and terephthalic acid, glass transition temperature (Tg): 68° C., weight-average molecular weight (Mw): 10000, molecular weight distribution (Mw/Mn): 5.12)

Fischer-Tropsch wax (melting point 78° C.): 7.0 parts

A polymerizable monomer composition is prepared by adding the above-listed materials to the above-mentioned colorant dispersion liquid, heating the mixture to 65° C., and then uniformly dissolving and dispersing the mixture at 500 rpm by using T.K. HOMO MIXER (made by Tokushu Kika Kogyo Co., Ltd.).

Granulation Step

After adjusting a temperature of the aqueous medium 1 to 70° C., under a condition of keeping a rotation speed of the T.K. HOMO MIXER at 15000 rpm, the polymerizable monomer composition is put into the aqueous medium 1 and 10.0 parts of t-butyl peroxybivalate serving as a polymerization initiator is added. Granulation is performed as it is for 10 min while the agitator is maintained at 15000 rpm.

Polymerization Step and Distillation Step

After the granulation step, polymerization is performed by replacing the agitator with a propeller agitation blade, continuing the polymerization for 5.0 hours under agitation at 150 rpm while temperature is kept at 70° C., and, after raising the temperature to 85° C., keeping such a condition for 2.0 hours.

Then, a resin particle dispersion liquid is obtained by replacing the reflux pipe of the reaction container with a cooling pipe, heating a resulting slurry to 100° C. to distill the slurry for 6 hours, and removing the unreacted polymerizable monomer through the distillation.

Step of Forming Organic Silicon Polymer 60.0 Parts of ion exchanged water is weight and put into a reaction container equipped with an agitator and a thermometer, pH is adjusted to 4.0 with 10% by mass of hydrochloric acid. The ion exchanged water is heated to a temperature of 40° C. under agitation. Thereafter, 40.0 parts of methyltriethoxysilane that is an organic silicon compound (OS) is added, and hydrolysis is performed for 2 hours or longer under agitation.

The end of the hydrolysis is confirmed by visually checking that oil and water form one layer without separating, and a hydrolysis liquid of the organic silicon compound is obtained after cooling.

After adjusting a temperature of the resin particle dispersion liquid, obtained as described above, to 55° C., 25.0 parts of the hydrolysis liquid of the organic silicon compound (added amount of the organic silicon compound is 10.0 parts) is added to the resin particle dispersion liquid to initiate polymerization of the organic silicon compound (OS). After continuing the polymerization as it is for 0.25 hours, pH is adjusted to 5.5 with an aqueous solution of 3.0% of sodium hydrogen carbonate. A toner particle dispersion liquid is obtained by, after holding an obtained organic silicon polymer for 1.0 hour (condensation reaction 1) while the agitation is continued at 55° C., adjusting pH to 9.5 with an aqueous solution of 3.0% of sodium hydrogen carbonate, and further holding the organic silicon polymer in such a condition for 4.0 hours (condensation reaction 2).

Washing Step and Drying Step

After the end of the step of forming the organic silicon polymer, the toner particle dispersion liquid is cooled, hydrochloric acid is added to the toner particle dispersion liquid to adjust pH to be 1.5 or below, and the toner particle dispersion liquid is left to stand for 1.0 hour under agitation.

Thereafter, the toner particle dispersion liquid is subjected to solid-liquid separation with a pressure filter, and a toner cake is obtained.

The obtained toner cake is converted to a dispersion liquid again through reslurry using ion exchanged water, and a toner cake is obtained by solid-liquid operation using the above-mentioned pressure filter.

Toner particles are obtained by transferring the above-obtained toner cake into a constant temperature oven at 40° C., and by drying and classifying the toner particles for 72 hours. The area occupancy of organic silica (organic silicon compound OS) in a surface layer PSL containing the organic silica is 58%.

Then, 0.6 parts of a silica particle with a particle diameter of 100 nm in the terms of a primary particle is externally added, as the spacer particle SP, to 100 parts of the toner particle by using the Henschel mixer (Model FM10C, made by NIPPON COKE & ENGINEERING, CO., LTD).

Measurement of Organic Silicon-Containing Surface Layer PSL

20 G of an aqueous solution containing 30% by mass of a precision-machine washing neutral detergent with pH 7, which is composed of "Contaminon N" (nonionic surfactant), an anionic surfactant, and an organic builder, is weighed and put into a vial with a capacity of 50 mL and is mixed with 1 g of the toner.

A prepared mixture is set into "KM Shaker" (model: V.SX) made by IWAKI INDUSTRY CO., LTD. and is shaken for 120 sec with "speed" set to 50. With the shaking, the silica fine particle tending to easily depart from the toner surface is shifted to the dispersion liquid side from the surface of the toner base particle or the toner particle. Thereafter, the toner is separated from the external additives, such as the silica fine particle having been shifted to a supernatant, through centrifugal separation using a centrifugal separator (H-9R: made by KOKUSAN Co., Ltd.) (5 min according to 16.67S-1). The precipitated toner is dried and solidified through vacuum drying (40° C./24 hours), whereby the toner is obtained after washing with water.

Then, an image of the toner (after the washing with water) is taken by Hitachi Super-High Resolution Field-Emission Electron Scanning Microscope S-4800 (made by Hitachi High Technologies Corporation).

Identification of a measurement target is performed by an element analysis using the energy dispersive X-ray spectroscopy (EDS). A 5 k ten-thousand magnification is used as an analysis size capable of reflecting the toner surface. An occupancy (area occupancy) H of the organic silica (OS), represented by a percentage of an area occupied by silica atoms in an analysis area, is calculated.

Figure 10:
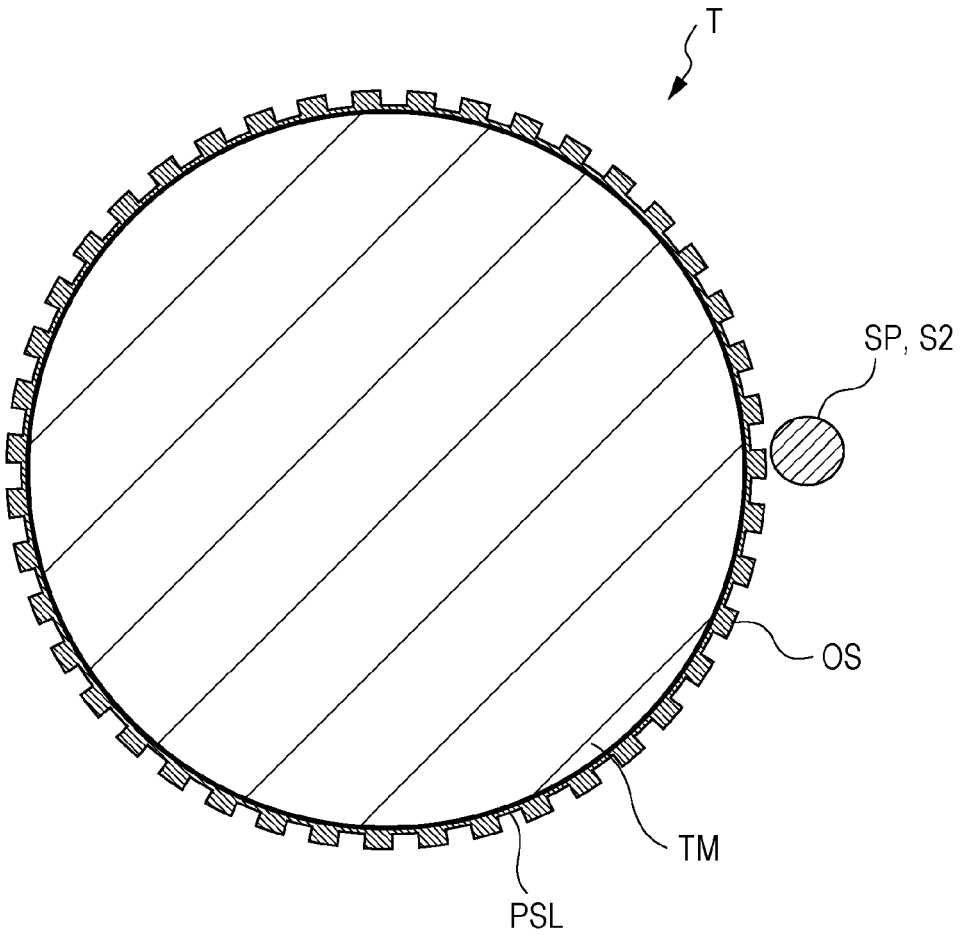
FIG. 10 is a conceptual sectional view of a developer used in Example 6 of the present disclosure.

The toner particle obtained by the manufacturing process described in Example 6 has the organic silica-containing surface layer PSL made of the organic silicon compound OS. Furthermore, the area occupancy H of the organic silicon compound OS in the organic silica-containing surface layer PSL is 40% or more with respect to the inorganic spacer particle SP with the particle diameter of 50 nm to 150 nm. Moreover, in Example 6, from the viewpoint of "fixing", the area occupancy H of the organic silicon compound OS in the organic silica-containing surface layer PSL is desired to be 75% or less as in Example 1. Thus, also in Example 6, the area occupancy H of the organic silicon compound OS is preferably in the range of 0.40 to 0.75. FIG. 10 is a conceptual sectional view of the developer used in Example 6.

Table 1 given below indicates main specification data of the developing apparatuses according to the above-described Examples 1 to 6, Reference Example, and Comparative Example 1.

The item "Toner Intake Defined by Regulation Member" in Table 1 denotes a toner intake that is positioned in the abutment region (nip) between the developing blade and the developing roller on the upstream side in the rotation direction of the developing roller. For example, comparing with the case, illustrated in FIG. 7, in which the "edge (intersection 23*a*23)" of the front end of the developing blade is abutted with the developing roller, the size of the toner intake defined by the regulation member is larger in the case of FIG. 8 in which the "flat portion (opposing surface 23*a*22)" of the front end of the developing blade is abutted with the surface of the developing roller.

TABLE 1

| | Toner Intake Defined by Regulation Member | Developing Blade Bias Δ | Silica Fine Particle S1 (or Organic Silica-Containing Surface Layer) on Surface of Toner Base Particle | | Spacer Particle SP |
|---|---|---|---|---|---|
| | | | Material | Silica Occupancy | |
| Example 1 | small | 0 V | silica | 60% | silica |
| Related Art (Reference Example) | small | 0 V | low coating | 32% | — |
| Comparative Example 1 | small | 0 V | none | 32% | silica |
| Example 2 | large | 0 V | silica | 60% | silica |
| Example 3 | small | 0 V | silica | 60% | alumina |
| Example 4 | small | −100 V | silica | 60% | silica |
| Example 5 | small | −100 V | silica | 60% | alumina |
| Example 6 | small | −100 V | organic silica | 58% | silica |

The above-described calculation is performed on ten toners, and an average of ten calculated values is regarded as the area occupancy H of the organic silica (OS).

The area occupancy H of the organic silica (OS) in this Example is 58%.

When the area occupancy H of the organic silica (OS) is 40% or more, the fixed adhesion of the spacer particle to the toner base particle can be effectively suppressed. Furthermore, when the area occupancy H of the organic silica (OS) is 40% or more, the sufficient charge amount can be given to the toner.

On the other hand, the area occupancy H of the organic silica (OS) is preferably 75% or less for the following reason. If the area occupancy H is more than 75%, the toner becomes difficult to fuse when heated (for example, 100° C. or higher), thus causing a possibility of a fixing failure.

Evaluation Methods

The developing apparatuses according to the above-described Examples 1 to 6, Reference Example, and Comparative Example 1 listed in Table 1 were evaluated on the following items. The evaluation results are listed in Table 2.

Evaluation methods will be described in detail below.

(1) Evaluation of Fogging Under High Humidity Environment

The term "fogging" implies an image defect that the toner is faintly developed and appears like scumming in a white region (unexposed region) where no image is to be printed. A method of evaluating a fogging amount is as follows.

The operation of the image forming apparatus was stopped during printing of a solid white image. The toner on the photosensitive drum at timing after development and before transfer was transferred onto a transparent tape, and the tape including the toner attached thereto was pasted to recording paper, for example. Simultaneously, a tape including no toner attached thereto was also pasted to the same recording paper. An optical reflectivity of each of the tapes pasted to the recording paper was measured from above the tape by an optical reflectometer (TC-6DS, made by Tokyo Denshoku K.K.) using a green filter, and a fogging amount was evaluated by subtracting the measured reflectivity of the toner-attached tape from that of the toner not-attached tape. The fogging amount was determined by measuring the reflectivity at three or more points on each tape, and by calculating an average value of measured values.

A: The fogging amount was less than 1.0%.

B: The fogging amount was 1.0% or more and less than 3.0%.

C: The fogging amount was 3.0% or more and less than 5.0%.

D: The fogging amount was 5.0% or more. (The image defect appeared significantly.)

The evaluation of the fogging was performed after leaving the tapes to stand for 24 hours under a test environment at 30° C. and 80% RH after the end of printing of 3000 sheets. A print test was performed by continuously passing a horizontal line image with an image percentage of 5%. More specifically, an image obtained by repeating a cycle of printing a 1 dot line and thereafter not-printing 19 dot lines was used as the horizontal line image with the image percentage of 5%.

(2) Evaluation of Development Streak Under Low Humidity Environment

Evaluation of a development streak under a low humidity environment was performed by outputting a solid black image and a halftone image, and by visually determining the images in accordance with the following criteria.

A: A density variation in the form of a vertical streak did not occur in both the solid black image and the halftone image.

B: The density variation in the form of a vertical streak did not occur in the solid black image, but was visually recognized in the halftone image.

C: The density variation in the form of a vertical streak was visually recognized in both the solid black image and the halftone image.

The evaluation of the development streak under the low humidity environment was performed after leaving the images to stand for 24 hours under a test environment at 15° C. and 10% RH after the end of printing of 3000 sheets. A print test was performed by continuously passing a horizontal line image with an image percentage of 5%. More specifically, an image obtained by repeating a cycle of printing a 1 dot line and thereafter not printing 19 dot lines was used as the horizontal line image with the image percentage of 5%.

This evaluation aims to evaluate an adverse effect on an image when a wear variation in a longitudinal direction is caused in the developing roller near the toner intake defined by the developing blade. In a region where a wear amount is large, because the size of the toner intake is increased, a bearing amount is increased in part of a toner coating layer on the developing roller in the longitudinal direction, and a vertical streak with a higher density is generated on a uniform image.

(3) Evaluation of Dot Reproducibility Under High Humidity Environment

Evaluation of dot reproducibility under s high humidity environment was performed by outputting a 2-dot image and visually determining the output image in accordance with the following criteria. More specifically, the 2-dot image was obtained as follows. After printing 2 dots, 80 dot lines were not printed. Then, 80 dots were not printed in a main scan direction. An image formed by repeating the above-mentioned cycle was used. The evaluation was performed after leaving the images to stand for 24 hours under a test environment at 30° C. and 80% RH after the end of printing of 100 sheets and 3000 sheets.

A: The dots in the dot images were visually recognizable in both the cases after the printing of 100 sheets and 3000 sheets.

B: The dots in the dot images were visually recognizable in the case after the printing of 100 sheets, but were not visually recognizable in the case after the printing of 3000 sheets.

C: The dots in the dot images were not visually recognizable in both the cases after the printing of 100 sheets and 3000 sheets.

(4) Evaluation of Development Streak Under High Humidity Environment

Evaluation of uniformity of a solid black image was performed by outputting a solid black image and a halftone image, and by visually determining the output images in accordance with the following criteria.

A: The density variation in the form of a vertical streak did not occur in both the solid black image and the halftone image.

B: The density variation in the form of a vertical streak did not occur in the solid black image, but was visually recognized in the halftone image.

C: The density variation in the form of a vertical streak was visually recognized in both the solid black image and the halftone image.

The evaluation of the development streak under the high humidity environment was performed after leaving the images to stand for 24 hours under a test environment at 30° C. and 80% RH after the end of printing of 100 sheets.

This evaluation aims to evaluate the image defect in the case in which the spacer particle adheres to part of the developing blade in the longitudinal direction.

When an adherent made of the spacer particle, for example, is formed near the toner intake defined by the developing blade, an amount of the taken-in toner is reduced in a region where the adherent is formed. In that region, therefore, the bearing amount of the toner coating layer is reduced in comparison with a region where the adherent is not formed. As a result, an image with a faint vertical streak is generated.

(5) Evaluation of End Coating Defect Under Low-Temperature and Low-Humidity Environment Toner having become easy to aggregate with deterioration of the toner is difficult to be regulated by the developing blade, and the bearing amount in the toner coating layer is increased (this phenomenon is significant particularly in an end portion). Hence an end coating defect is caused.

To evaluate uniformity of the toner coating layer in the longitudinal direction, the evaluation was performed using a halftone image and a solid white image. The halftone image and the solid white image were continuously passed under an environment at 15.0° C. and 10% RH immediately after the end of printing of 3000 sheets. In a print test, a horizontal line image with an image percentage of 5% was continuously passed. The evaluation was made in accordance with the following criteria.

A: In each of the images, a shade variation in the form of a vertical strip was not recognizable in both end portions of the image.

B: In the halftone image, the shade variation in the form of a vertical strip was recognized in the end portion of the image.

C: In the solid white image, the shade variation in the form of a vertical strip was recognized in the end portion of the image.

In this evaluation, the halftone image includes, in a microscopic view, a stripe pattern formed by repeating a cycle of recording 1 line in the main scan direction and then not recording 4 lines. In an overall view, the halftone image represents a halftone density.

Evaluation Results

Table 2 indicates the evaluation results of Examples 1 to 6, Related Art (Reference Example), and Comparative Example 1.

TABLE 2

| | (1) High-Humidity Fogging | (2) Low-Humidity Development Streak | (3) High-Humidity Dot Reproducibility | (4) High-Humidity Development Streak | (5) Low-Humidity Regulation Failure |
|---|---|---|---|---|---|
| Example 1 | B | A | B | A | B |
| Related Art (Reference Example) | D | A | B | A | A |
| Comparative Example 1 | C | C | B | A | C |
| Example 2 | C | A | C | A | B |
| Example 3 | B | B | B | B | B |
| Example 4 | A | A | A | A | B |
| Example 5 | A | B | A | B | B |
| Example 6 | A | A | A | A | A |

Superiority of the present disclosure to Related Art (Reference Example) will be described below by comparing Example 1 and Reference Example.

Since the spacer particle SP in Example 1 is interposed between the toners, the surfaces of the toner base particles TM can be prevented from contacting with each other. As a result, the toner can be held in an easily movable state.

In addition, in Example 1, the toner forms a state in which the area occupancy H of the silica fine particle S1 on the surface of the toner base particle is high. Therefore, the contact between the spacer particle SP and the surface of the toner base particle TM is suppressed, whereby a release property between the toner and the spacer particle can be ensured and the fixed adhesion of the spacer particle to the toner base particle due to, for example, stress applied to the toner can be suppressed. As a result, the toner flowability can be maintained and a stable image can be obtained throughout long use (cumulative use time) from the beginning (start of use).

On the other hand, in Related Art (Reference Example), the area occupancy H of the silica fine particle S1 on the surface of the toner base particle TM is low (low coating), and the spacer particle SP is not used. Because of not using the spacer particle, contact between the surfaces of the toner base particles increases and unevenness formed by the silica fine particles S1 on the toner surface reduces due to, for example, the stress applied to the toner. As a result, the toner flowability is reduced and, when the toner passes the nip (abutment region) between the developing roller and the developing blade, an opportunity of triboelectric charging between the developing blade and the toner is reduced. Therefore, a charge holding amount of the toner is reduced, and fogging tends to increase during long use.

In Example 1, a better result is obtained for the fogging than in Reference Example throughout long use. Because the area occupancy H of the silica fine particle S1 on the surface of the toner base particle TM is high and the spacer particle SP is used, a change in unevenness of the toner surface is small throughout long use. In addition, since the spacer particle SP is present between the toners and between the toner and the other member, the toner surfaces are harder to directly contact with each other, whereby a reduction in the surface unevenness due to the presence of the silica fine particle S1 can be suppressed. As a result, good toner flowability can be maintained and an increase in the fogging amount can be effectively suppressed throughout long use.

The advantageous effects of the present disclosure will be described below by comparing Comparative Example 1 and Example 1.

In Comparative Example 1, although the spacer particle SP is used, the area occupancy H of the silica fine particle S1 on the surface of the toner base particle TM is low. Because of using the spacer particle SP, a reduction in the toner flowability due to deterioration of the toner can be suppressed, and an increase in the fogging amount with long use is small. However, the vertical streak in the solid image becomes significant. The reason is as follows.

In Comparative Example 1, because the area occupancy H of the silica fine particle S1 on the surface of the toner base particle TM is low in spite of using the spacer particle SP, a contact frequency between the toner base particle TM and the spacer particle SP increases. With an increase in the contact frequency between the toner base particle TM and the spacer particle SP, the spacer particle SP tends to fixedly adhere to the toner base particle TM due to, for example, the stress applied to the toner.

Figure 9A:
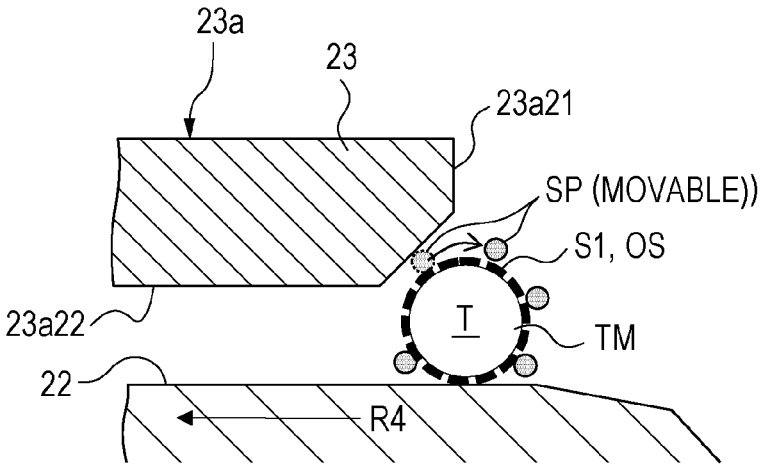
FIGS. 9A and 9B are each a conceptual view illustrating a wear generation mechanism at the front edge (abutment) portion of the developing blade by the spacer particle.
Figure 9B:
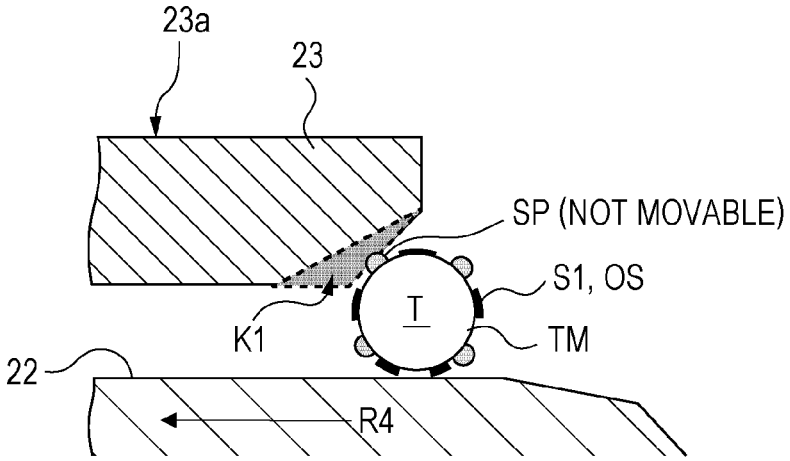

FIG. 9B is a conceptual view illustrating a situation when the toner including the spacer particle SP fixedly adhering to the toner base particle comes into abutment with the developing blade while the toner is held on the developing roller.

Because the spacer particle SP fixedly adheres to the surface of the toner base particle TM and is not movable over the toner surface, the spacer particle wears the front edge of the metal-made developing blade (worn area "K1" is denoted in FIG. 9B).

The toner to which the spacer particle SP has fixedly adhered is partly generated in the longitudinal direction, and hence a wear variation in the regulation member (blade) occurs in the longitudinal direction. The wear variation in the front edge of the developing blade leads to a variation in regulation force in the longitudinal direction and causes a variation in the toner coating amount on the developing roller in the longitudinal direction. As a result, the vertical streak is generated in the solid image.

On the other hand, in Example 1, since the spacer particle SP adheres to the toner base particle forming a state that the area occupancy H of the silica fine particle S1 on the surface of the toner base particle TM is high, the fixed adhesion of the spacer particle to the toner base particle due to, for example, stress applied to the toner can be suppressed. Thus, a high release property can be maintained between the toner and the spacer particle.

As illustrated in FIG. 9A, the spacer particle SP in Example 1 is easily movable from the toner base particle TM. Therefore, even when the spacer particle on the surface of the toner base particle receives high stress from the regulation member at the time of the toner on the developing roller passing by the regulation member, the spacer particle can move from the surface of the toner base particle and the stress applied to the spacer particle can be reduced. It is hence possible to avoid a local increase in pressure between the spacer particle and the metal blade, and to suppress the wear variation at the front edge of the developing blade in the longitudinal direction.

As described above, the configuration of Example 1 can effectively suppress the wear variation at the front edge of the developing blade in the longitudinal direction, the variation in the regulation force, the variation in the toner coating amount on the developing roller in the longitudinal direction, and the generation of the vertical streak in the solid image. If the spacer particle has a large size, the wear amount at the front edge of the developing blade is increased. To suppress the wear of the front edge of the developing blade, the particle diameter of the spacer particle is preferably 150 nm or less and more preferably 120 nm or less.

Examples 2 and 3 that are modification examples of Example 1 will be described below.

First, a configuration of Example 2 is described.

In Example 2, the size of the toner intake defined by the developing blade is set to be larger than that in Example 1. In the configuration of Example 2, therefore, an amount of the toner passing by the developing blade 23 is larger than in Example 1. Accordingly, in Example 2, the amount of the toner incapable of contacting with the developing blade increases slightly, and the amount of the toner not having a high charge amount also increases slightly in comparison with those in Example 1.

Consequently, comparing with Example 1, the dot reproducibility is relatively reduced and the fogging during long use is relatively slightly increased in Example 2. As in Example 1, however, a high regulation force can be developed at a regulation position. As a result, the dot reproducibility and the fogging during long use under the high humidity environment can be effectively suppressed.

Next, a configuration of Example 3 is described.

In Example 3, alumina (particle) is used as the spacer particle SP. Alumina has a reverse polarity to the charging polarity of the toner. Comparing with Example 1, therefore, the spacer particle made of alumina in Example 3 is more apt to electrically adhere to the silica fine particle S1 on the surface of the toner base particle TM. Thus, although the release property between the spacer particle and the toner base particle is relatively reduced, substantially similar advantageous effects to those in Example 1 can be obtained.

Configurations of Examples 4 and 5 of the present disclosure will be described below.

In each of Examples 4 and 5, to promote charge application to the toner, a voltage with the same polarity as the regular charging polarity of the toner relative to a potential of the developing roller is applied to the developing blade. The spacer particle SP used in Example 4 is the silica particle S2, and the spacer particle SP used in Example 5 is the alumina (particle)

More specifically, while the voltage between the developing roller and the developing blade is 0 V in Example 1 described above, a voltage is applied to the developing blade with a potential difference of −100 V relative to the developing roller in Examples 4 and 5.

In Examples 4 and 5, the chargeability of the toner is improved, and more satisfactory results are obtained in the dot reproducibility and the fogging during long use than in Example 1.

On the other hand, regarding streak-like fogging under the H/H (high temperature and high humidity) environment, a better result is obtained in Example 4 than in Example 5.

More specifically, the spacer particle SP in Example 5 is made of the alumina (particle). The alumina has a triboelectric charging polarity reversal to that of the toner.

In Example 5, therefore, the toner passes between the developing blade and the developing roller in a state that the toner has a "negative" charge and the alumina of the spacer particle SP has a "positive" charge. In Example 5, because the developing blade has the potential difference of −100 V relative to the developing roller, the "negative charge" receives an electrical force acting toward the developing roller side, and the "positive charge" receives an electrical force acting toward the developing blade side. Accordingly, the alumina of the spacer particle receives the electrical force acting toward the developing blade side and becomes more likely to adhere to the developing blade.

When the alumina adheres to part of the front edge of the developing blade in the longitudinal direction, the size of the toner intake in a region where the alumina has adhered is reduced, and the toner amount in the toner coating layer in the region where the alumina has adhered is also reduced. This may lead to a possibility of causing a streak-like density difference on a uniform image. By observing part of the developing blade corresponding to a region where a streak has generated on the image, the inventors of this application have confirmed that a content of alumina in the adherent is relatively large and the streak on the image is reduced after removing the adherent.

On the other hand, in Example 4, the voltage is applied to the developing blade with the potential difference of −100 V relative to the developing roller, and the silica particle S2 is used as the spacer particle SP. Therefore, both the toner and the spacer particle SP have the negative polarity, and hence soling of the developing blade can be suppressed. Thus, in Example 4, a reduction in the toner flowability due to a change caused with long use and the soiling of the developing blade can be more effectively regulated and image quality is improved due to higher chargeability in comparison with Example 5.

Next, Example 6 of the present disclosure is described.

Example 6 is different from Example 4 in that a front layer of the toner particle is made of organic silica (organic silicon polymer).

Because of being heated at a relatively low temperature in a production process, organic silica has lower hardness than inorganic silica (Example 4). Therefore, the surface layer containing the organic silica can further suppress the wear of the front edge of the developing blade upon contacting with the front edge. As a result, comparing with Example 4, Example 6 can maintain a higher regulation force of the developing blade throughout long use, can increase the bearing amount of the toner coating layer, and can further suppress the regulation failure under the low humidity environment.

The silica fine particle S1 on the surface of the toner base particle TM in Example 4 is an inorganic particle and has high hardness. There is hence a possibility that, when the developing blade and the silica fine particle contact with each other, the front edge of the developing blade may be slightly worn and the regulation force of the developing blade may be slightly reduced. Accordingly, it can be said that Example 6 is more advantageous than Example 4 in stability of the bearing amount of the toner coating layer and retention of regulation performance under the low humidity environment.

Relation Between Area Occupancy H of Silica Fine Particle S1 on Surface of Toner Base Particle and Inorganic Spacer Particle SP A relation between the area occupancy H of the silica fine particle S1 on the surface of the toner base particle TM and the inorganic spacer particle SP will be described below.

Table 3 given below indicates configurations and evaluation results of Examples 7 to 10 and Comparative Examples 2 to 6. Table 3 further indicates the configurations (refer to Table 1) and the evaluation results (refer to Table 2) of the above-described "Example 1" and "Comparative Example 1.

Examples 7 to 10 are basically in accordance with Example 1 but is different from Example 1 in the following points.

More specifically, in Examples 7, 8, 9 and 10, the area occupancies of the silica fine particles S1 on the surfaces of the toner base particles are respectively 42%, 42%, 74%, and 74%.

The above-mentioned area occupancies of the silica fine particles S1 were appropriately set by adjusting the amount of the fixed silica to be added.

Furthermore, in Examples 7, 8, 9 and 10, the particle diameters of the inorganic spacer particles SP are respectively 50 nm, 150 nm, 50 nm and 150 nm.

Comparative Examples 2 to 5 are basically in accordance with Example 1 but are different from Example 1 in the following points.

More specifically, in Comparative Examples 2, 3, 4 and 5, the area occupancies of the silica fine particles S1 on the surfaces of the toner base particles are respectively 38%, 80%, 60%, and 74%.

The above-mentioned area occupancies of the silica fine particles S1 were appropriately set by adjusting the amount of the fixed silica to be added.

Furthermore, in Comparative Examples 2, 3, 4 and 5, the particle diameters of the inorganic spacer particles SP are respectively 200 nm, 100 nm, 30 nm and 200 nm.

The above-described evaluations of (1) fogging under high humidity, (2) development streak under low humidity, and (4) development streak under high humidity were performed on Examples 7 to 10 and Comparative Examples 2 to 5 as well. The evaluation results are listed in Table 3.

TABLE 3

| | Area Occupancy of Silica Fine Particle S1 (%) | Diameter of Inorganic Spacer Particle SP (nm) | (1) Fogging at High Humidity | (2) Development Streak at Low Humidity | (4) Development Streak at High Humidity |
|---|---|---|---|---|---|
| (Example 1) | (60) | (100) | (B) | (A) | (A) |
| Example 7 | 42 | 50 | B | A | A |
| Example 8 | 42 | 150 | B | A | A |
| Example 9 | 74 | 50 | B | A | A |
| Example 10 | 74 | 150 | B | A | A |
| (Comparative Example 1) | (32) | (100) | (C) | (C) | (A) |
| Comparative Example 2 | 38 | 200 | D | B | B |
| Comparative Example 3 | 80 | 100 | D | A | C |
| Comparative Example 4 | 60 | 30 | D | A | A |
| Comparative Example 5 | 74 | 200 | D | A | C |

As seen from Table 3, in Examples 1 and 7 to 10, there are no image defects, and good results are obtained.

On the other hand, in Comparative Examples 1 and 2, the area occupancy H of the silica fine particle S1 on the surface of the toner base particle is too low (less than 40%). Therefore, when the number of printed sheets (cumulative use time) increases, stress is applied to the toner, and the inorganic spacer particle fixedly adheres to the toner base particle. As described above, if the inorganic spacer particle fixedly adheres to the toner base particle, the front edge of the developing blade is partly worn, and the development streak at low humidity is generated.

In Comparative Examples 2, 3 and 5, because the inorganic spacer particle is too large (more than 150 nm), the release property with respect to the toner is high, and the inorganic spacer particle tends to adhere to the front edge of the developing blade. Accordingly, the development streak at high humidity is generated.

In Comparative Example 4, the inorganic spacer particle is too small (less than 40 nm). Therefore, when the number of printed sheets (cumulative use time) increases and stress is applied to the toner, the adjacent toners come closer to each other and the toner flowability reduces. As a result, the toner becomes difficult to receive the charge from the developing blade, and hence the fogging at high humidity environment becomes significant.

Thus, in the above-described examples, by setting the area occupancy H of the silica fine particle on the surface of the toner base particle to be 40% or more and the particle diameter of the inorganic spacer particle SP to be 50 to 150 nm, the wear of the front edge of the metal-made developing blade can be effectively suppressed while high chargeability is maintained. As a result, a stable good image can be obtained during long use (even with an increase in the cumulative use time).

The features of the present disclosure can be summarized as follows.

(1) A developing apparatus (4) according to the present disclosure includes a developing frame (24) configured to store a developer (T), a developer bearing member (22) rotatably supported by the developing frame (24) and configured to bear the developer, and a regulation member (23) including a metal blade (23*a*), the metal blade having one end (23*a*1) fixed to the developing frame and the other end (23*a*2) arranged in contact with the developer bearing member, the regulation member regulating a thickness of the developer borne on the developer bearing member.

The developer (T) includes a toner base particle (TM) and external additives (S1, SP).

The external additives include a silica particle (S1) with a particle diameter (n) of 5 nm or more and 25 nm or less, and an inorganic spacer particle (SP) with a particle diameter (r1) of 50 nm or more and 150 nm or less.

An area occupancy (H) of the silica particle (S1) on a surface of the toner base particle is 40% or more.

(2) A developing apparatus (4) according to the present disclosure includes a developing frame (24) configured to store a developer (T), a developer bearing member (22) rotatably supported by the developing frame (24) and configured to bear the developer, and a regulation member (23) including a metal blade (23*a*), the metal blade having one end (23*a*1) fixed to the developing frame and the other end (23*a*2) arranged in contact with the developer bearing member, the regulation member regulating a thickness of the developer borne on the developer bearing member.

The developer includes a toner base particle (TM) with an organic silica-containing surface layer (PSL) made of an organic silicon compound (OS), and an external additive (SP).

The external additive includes an inorganic spacer particle (SP) with a particle diameter (r1) of 50 nm or more and 150 nm or less.

An area occupancy (H) of the organic silicon compound (OS) on a surface of the toner base particle is 40% or more.

(3) In the developing apparatus according to the present disclosure, the other end (23*a*2) of the metal blade may be arranged to extend toward an upstream side in a rotation direction (R4) of the developer bearing member.

(4) In the developing apparatus according to the present disclosure, when looking along a rotation axis direction (X1) of the developer bearing member, and when the developer bearing member (22) is imaginarily assembled into the developing frame (24), in a state in which the developer bearing member is not assembled in the developing frame and the regulation member is assembled, an intersection (23*a*23), at which a front edge surface (23*a*21) at the other end of the metal blade intersects an abutment surface (23*a*22) thereof abutting with the developer bearing member, may be positioned within an imaginary outer diameter circumference (MC1) of the developer bearing member, and may be positioned in a first imaginary area (TD1) which is located on one side of the first imaginary plane (SF1) where the metal blade is present, when a first imaginary plane (SF1) passing a rotation center (X0) of the developer bearing member and being parallel to the abutment surface (23*a*22) is a reference.

(5) In the developing apparatus according to the present disclosure, when the first imaginary plane (SF1) and a second imaginary plane (SF2) perpendicular to the first imaginary plane are references, the intersection (23*a*23) may be positioned on a downstream side of the second imaginary plane and on an upstream side of the first imaginary plane in the rotation direction of the developer bearing member, within the first imaginary area.

(6) In the developing apparatus according to the present disclosure, when the first imaginary plane (SF1) and a second imaginary plane (SF2) perpendicular to the first imaginary plane are references, the intersection (23*a*23) may be positioned on an upstream side of the second imaginary plane and on a downstream side of the first imaginary plane in the rotation direction of the developer bearing member, within the first imaginary area.

(7) In the developing apparatus according to the present disclosure, a bias, with the same polarity as a regular charging polarity of the developer (T), relative to the developer bearing member (22), may be applied to the metal blade (23*a*).

(8) In the developing apparatus according to the present disclosure, a charging polarity of the inorganic spacer particle (SP) may be the same as the regular charging polarity of the developer.

(9) In the developing apparatus according to the present disclosure, the silica particle (S1) may be fixed to the toner base particle (TM).

(10) In the developing apparatus according to the present disclosure, the inorganic spacer particle (SP) may be another silica particle (S2).

(11) In the developing apparatus according to the present disclosure, the particle diameter (r1) of the inorganic spacer particle is preferably 80 nm or more and 150 nm or less, and the area occupancy (H) of the silica particle (S1) on the surface of the toner base particle (TM) is preferably 45% or more.

(12) In the developing apparatus according to the present disclosure, the area occupancy (H) of the silica particle (S1) on the surface of the toner base particle (TM) is preferably 75% or less.

(13) A process cartridge (S) according to the present disclosure includes the developing apparatus (4) and an image bearing member (1) configured to bear a developer image (T), the process cartridge being removably attachable to an image forming apparatus.

(14) An image forming apparatus (100) according to the present disclosure includes the developing apparatus (4) or the process cartridge (S), and a transfer member (14).

According to the present disclosure, the occurrence of the coating variation can be suppressed while the chargeability of the developer coating layer formed on the developer bearing member is improved.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A developing apparatus comprising:

a developing frame configured to store a developer;

a developer bearing member rotatably supported by the developing frame and configured to bear the developer, and a regulation member including a metal blade, the metal blade having one end fixed to the developing frame and the other end arranged in contact with the developer bearing member, the regulation member regulating a thickness of the developer borne on the developer bearing member, wherein the developer includes a toner base particle having an organic silicon polymer made of an organic silicon compound, and an external additive, the external additive includes an inorganic spacer particle with a particle diameter of 50 nm or more and 150 nm or less, and an area occupancy of the organic silicon compound on a surface of the toner base particle is 40% or more.

2. The developing apparatus according to claim 1, wherein the other end of the metal blade is arranged to extend toward an upstream side in a rotation direction of the developer bearing member.

3. The developing apparatus according to claim 2, wherein, in a state in which the developer bearing member is not assembled and the regulation member is assembled in the developing frame, when looking along a rotation axis direction of the developer bearing member and when the developer bearing member is imaginarily assembled into the developing frame, when a first imaginary plane passing a rotation center of the developer bearing member and being parallel to the abutment surface is a reference, an intersection, at which a front edge surface at the other end of the metal blade intersects an abutment surface thereof abutting with the developer bearing member, is positioned within an imaginary outer diameter circumference of the developer bearing member, and is positioned in a first imaginary area, which is located on one side of the first imaginary plane where the metal blade is present.

4. The developing apparatus according to claim 3, wherein when the first imaginary plane and a second imaginary plane perpendicular to the first imaginary plane are references, the intersection is positioned on a downstream side of the second imaginary plane and on an upstream side of the first imaginary plane in the rotation direction of the developer bearing member, within the first imaginary area.

5. The developing apparatus according to claim 3, wherein when the first imaginary plane and a second imaginary plane perpendicular to the first imaginary plane are references, the intersection is positioned on an upstream side of the second imaginary plane and on a downstream side of the first imaginary plane in the rotation direction of the developer bearing member, within the first imaginary area.

6. The developing apparatus according to claim 1, wherein a bias with same polarity as a regular charging polarity of the developer is applied to the metal blade.

7. The developing apparatus according to claim 1, wherein a charging polarity of the inorganic spacer particle is same as the regular charging polarity of the developer.

8. The developing apparatus according to claim 1, wherein the inorganic spacer particle is a silica particle.

9. The developing apparatus according to claim 1, wherein the area occupancy of the organic silicon compound on a surface of the toner base particle is 75% or less.

10. A process cartridge comprising:

the developing apparatus according to claim 1; and an image bearing member configured to bear a developer image, the process cartridge being removably attachable to an image forming apparatus.

11. An image forming apparatus comprising:

the developing apparatus according to claim 10; and a transfer member.

12. An image forming apparatus comprising:

the developing apparatus according to claim 1; and a transfer member.

* * * * *